US006451379B1

(12) United States Patent
Tsao

(10) Patent No.: US 6,451,379 B1
(45) **Date of Patent: *Sep. 17, 2002**

(54) INCREASING DOT SIZE ON POROUS MEDIA PRINTED WITH PIGMENTED INKS

(75) Inventor: Yi-Hua Tsao, San Diego, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/545,934

(22) Filed: Apr. 10, 2000

Related U.S. Application Data

(63) Continuation-in-part of application No. 09/491,642, filed on Jan. 27, 2000.

(51) Int. Cl.[7] ..... B05D 3/10; B05D 1/38

(52) U.S. Cl. ..... 427/322; 427/337; 427/340; 427/407.1; 427/411; 427/412.2

(58) Field of Search ..... 427/322, 337, 427/340, 407.1, 411, 412.2; 428/304.4

(56) References Cited

U.S. PATENT DOCUMENTS

| | | | | |
|---|---|---|---|---|
| 4,746,543 A | * | 5/1988 | Zinkan et al. | 427/136 |
| 5,275,867 A | | 1/1994 | Misuda et al. | 428/195 |
| 5,576,088 A | * | 11/1996 | Ogawa et al. | 428/327 |
| 5,605,750 A | * | 2/1997 | Romano et al. | 428/304.4 |
| 5,989,378 A | * | 11/1999 | Liu et al. | 156/241 |
| 6,187,430 B1 | * | 2/2001 | Mukoyoshi et al. | 428/331 |

FOREIGN PATENT DOCUMENTS

EP 878322 A2 * 11/1998

* cited by examiner

*Primary Examiner*—Michael Barr

(57) ABSTRACT

It is found that by wetting coated media, such as film-based media (e.g., Mylar film) and resin-coated papers (e.g., photobase paper), with a dilute polymer solution or colloidal silica or colloidal alumina dispersion with small particle size, the dot size increases compared to the current default dot size when printed with pigment-based inks in a Hewlett-Packard CP-2500 or CP-3500 printer. No previous efforts are known to increase the dot size on coated porous media printed with pigment inks.

18 Claims, 3 Drawing Sheets

INCREASING DOT SIZE ON POROUS MEDIA PRINTED WITH PIGMENTED INKS

CROSS-REFERENCE TO RELATED APPLICATION

The present application is a continuation-in-part of application Ser. No. 09/491,642, filed Jan. 27, 2000.

TECHNICAL FIELD

The present invention is directed generally to ink jet printing, and, more particularly, to printing on porous print media with pigment-based ink jet inks.

BACKGROUND ART

Ink-jet receiving layers need to absorb the ink vehicle delivered during the printing process. When the ink-receiving layer is applied to non-absorbent substrate, the substrate provides no absorption capacity and as a result, the ink-receiving layer must be the sole absorbing material. To increase the absorbing capacity of the coating, an absorbent precoat has been described in the prior art that serves to increase the capacity of the coating, much as a substrate functions in paper-based ink-jet media.

A top coat is applied to control surface properties such as gloss, tackiness, surface energy, and durability, as well as to function in concert with the adsorbent precoat. In addition, the top coat must be free of defects that would contribute to perceived irregularities or non-uniformities in the coating.

U.S. Pat. No. 5,275,867 describes a two-layer coating and a coating process where a top coat is laminated on the precoat. U.S. Pat. No. 5,605,750 describes a three-layer coating and a coating process where the top coats are applied to the precoat by coating both fluids before drying in a multi-slot hopper or a slide hopper. U.S. Pat. No. 5 5,576, 088 describes a two layer coating and a coating process where a top coat is cast coated on a precoat. All these examples describe a process that involves specialized equipment and coatings engineered to be compatible with the processes. In addition, production efficiencies may be lower.

In related application Ser. No. 09/491,642, a process is disclosed and claimed that allows the production of multi-layer coatings in which one or more top coats can be applied to a porous base coat to produce a uniform and defect-free coating layer. Specifically, a process is provided in which a liquid is applied to the base coat prior to top coating such that the air in the base coat is removed prior to top coating. This process can occur in-line with a simple apparatus described therein. An added benefit of this method is that it also allows the possibility of adding functionally or performing chemistry to the coatings after the base coat is dried and before the top coat is applied in a single process. For example, the wetting liquid may contain, but is not limited to, surfactants, pH modifiers, polymers, crosslinkers, pigments, and/or dye stabilizers.

Conventional glossy media have polymer-coated surfaces. The ink penetrates the coating via polymer swelling, which is slow. After the image is printed, the printed surface remains saturated with the vehicle and the dry time is long. With porous media, the ink vehicle quickly absorbs into the porous coating via capillary action and the dry time is short. As demand for faster ink-jet printing increases, faster dry time of the media becomes more important.

Examples of porous glossy print media include (1) a high quality glossy paper, Epson White Film S041072 (an opaque polyester) for use with Epson's Stylus printer and (2) Accuplot EGF Glossy White Film, available from Mile High Engineering Supply Company (Denver, Colo.).

However, the dot size of pigment-containing inks on porous media has always been low, which results in white spaces between dots, and the image appears to be streaky and non-uniform. Ink and media joint investigations have been made in an effort to increase the dot size. While increasing the dot size of dye-based inks on polymer-coated photopaper can be done by lowering the surface tension of the ink in most cases, such an approach shows little effect with pigment-based inks on porous media.

In particular, in an attempt to improve dot size of pigment-based inks on coated porous print media, the following aspects have been examined: ink drop weight, media coating weight, pigment/binder ratio in the media coating, particle size in the media coating, and surfactants in inks or media. However, all of these experiments showed little effect on dot size.

Thus, there is a need to provide increased dot size of pigment-based inks on porous glossy media, for improved print quality thereon.

DISCLOSURE OF INVENTION

It is found that by rewetting coated media, such as film-based media (e.g., Mylar film) and resin-coated papers (e.g., photobase paper), with either a dilute polymer solution or a colloidal silica or colloidal alumina dispersion, the dot size increases compared to the current default dot size when printed with pigment-based inks in a Hewlett-Packard CP-2500 or CP-3500 printer. Examples of polymers suitable for use in the present invention include polyvinyl alcohol and polyvinyl acetate copolymer, polyvinyl pyrrolidone, and other water-soluble polymers such as polyamides, cellulose derivatives, and polethylene oxide. The colloidal silica or alumina dispersion have particle sizes in the range of about 1 to 300 nm.

Specifically, the process of the present invention is directed to applying at least one ink-receiving porous layer to a non-porous substrate. The process comprises:

(a) applying a porous base coat to a surface of the non-permeable substrate, the porous base coat comprising a plurality of pores;

(b) applying a first rewet liquid to the porous base coat;

(c) applying a porous top coat on the porous base coat; and (d) applying a second rewet liquid to the top coat, whereby the ink-receiving layer is printable with larger dots of a pigment-base ink than without the second rewet liquid.

No previous efforts are known to increase the dot size on coated porous media printed with pigment inks.

BEST MODES FOR CARRYING OUT THE INVENTION

Figure 1:
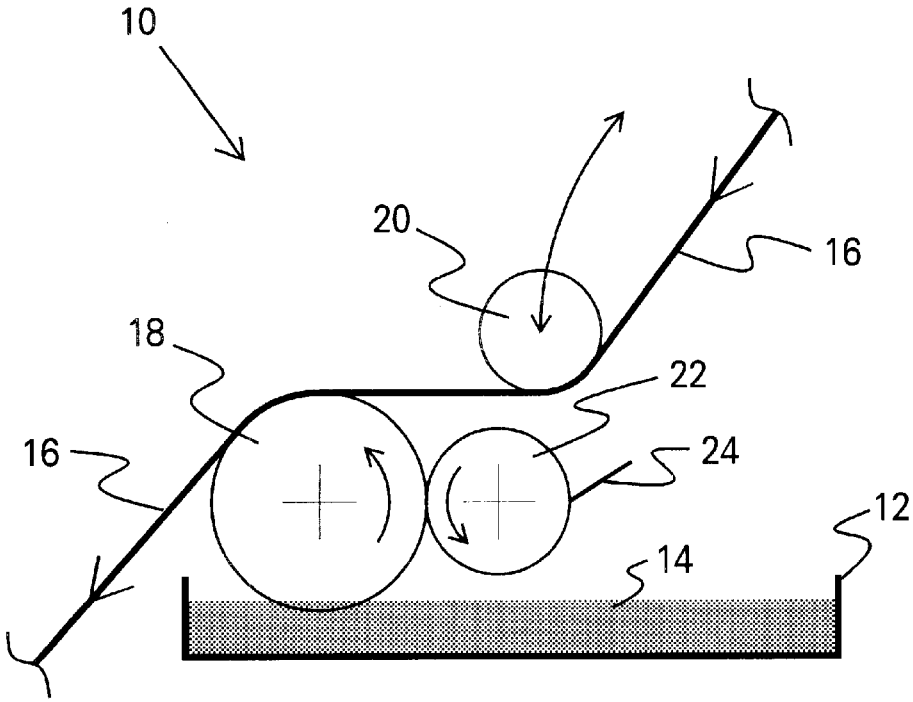
FIG. 1 illustrates apparatus useful in the practice of the present invention.

Reference is made now in detail to a specific embodiment of the present invention, which illustrates the best mode presently contemplated by the inventor for practicing the invention. Alternative embodiments are also briefly described as applicable.

The base coat and the top coat disclosed and claimed in related application Ser. No. 09/491,642 each comprise one or more pigments and one or more binders, which are polymeric compounds soluble or dispersible in the solvent in which the base coat and top coat are applied to the substrate. Examples of pigments include silica and alumina and its various hydrates, titania, carbonates (e.g., calcium carbonate, magnesium carbonate), glass beads, and organic pigments (e.g., plastic or polymer pigments such as cross-linked SBR latexes, micronized polyethylene or polypropylene wax, acrylic beads, and methacrylic beads). The pigment may be the same in both the base coat and top coat or different.

The binder is a polymeric matrix which serves, among other things, to hold the pigment(s) in place. The binder can be water-soluble or water-dispersible. Examples of water-soluble binders include polyvinyl alcohol and its derivatives, polyvinyl pyrrolidone/polyvinyl acetate copolymer, cellulose derivatives, polyamides, and polyethylene oxide. Examples of water-dispersed binders include styrene-butadiene latexes, polyacrylics, polyurethanes, and the like. The binder may be the same in both the base coat and top coat or different.

The base coat and top coat are separately applied in solution to the substrate and allowed to dry.

The substrate comprises non-permeable (non-air permeable) material, such as a film-based material, e.g., Mylar, or a resin-coated papers (e.g., photobase paper).

In the above-referenced application, pores in the base coat are saturated, or nearly saturated, with a liquid, also called a rewetting solution herein, before the top coat solution is applied. Preferably, the pores in the base coat are saturated with liquid before the top coat solution is applied. Also preferably, a solvent that is compatible with the solvent in the top coating is believed to give the best adhesion between coating layers.

The liquid may comprise one or more solvents. The liquid may be heated or chemically modified to increase the penetration rate in the precoat.

If heated, the liquid is heated to any temperature below its boiling point (or the minimum boiling point if two or more solvents are used).

By "chemically modified" is meant the addition of one or more surfactants, adhesion promoters, pH modifiers, polymers, crosslinkers, pigments, and/or dye stabilizers to the liquid. The chemically modified rewet solution thus serves to modify the properties of the base coat, top coat, the coating process, or the performance of the coatings as it relates to its use as a printing media. Any of the usual surfactants, pH modifiers, and/or crosslinkers may be used in the practice of the present invention. For example, where the binder in the base coat is polyvinyl alcohol, a suitable crosslinker added to the liquid is a borate or glyoxal. This process is especially useful for chemistries that are not compatible with the coating fluids or process.

It is also preferred that excess fluid on the surface of the base coat be removed before top coating. This can be accomplished by a nip, doctoring blade, or the like.

FIG. 1 shows apparatus 10 disclosed in connection with the above-mentioned patent application, which is also useful in the process of the present invention. The apparatus 10, which is a conventional coater, comprises a container 12 for containing a rewetting solution 14. A web 16 comprises the non-absorbent substrate and a porous base coat thereon and the solution 14 is introduced onto the surface of the porous base coat by means of an applicator roller 18. A hold-down roller 20 urges the web 16 against the top of the applicator roller 18. The applicator roller 18 applies the liquid 14 to the web 16. The liquid 14 is metered onto the applicator roller 18 by a metering roller 22, provided with a doctor 24, or other suitable means.

In an alternate embodiment, the excess rewet solution may be doctored off of the web.

In another alternative embodiment, the rewet solution can be metered by a pump directly onto the moving web 16, thus eliminating the need for doctoring.

The uptake of the liquid 14 depends on the speed of the web 16. It is desired to move the web 16 as fast as possible to maximize the coating efficiency.

The dwell time of the rewet fluid is defined as the time interval between application of the rewet fluid and application of the coating. The dwell time thus determines the length of time available for the rewet solution to penetrate into the base coat. The dwell time can be modified by the web speed and web distance between the rewet station and the coating station. The length of time required to obtain adequate saturation of the base coat is determined by the design of the rewet station, the base coat properties, the top coat properties, and the rewet fluid properties. For this process to be effective, all of these parameters need to be accounted for when designing the coating process.

That invention provides a number of advantages. First, it permits applying a top coat solution on porous base coats formed on non-porous substrates. Second, it permits incorporation of materials for either the base coat or the top coat that would otherwise be incompatible with each other. Third, it allows incompatible liquids to be coated in multilayer systems.

In accordance with the present invention, a rewet solution is applied to the top coat. The apparatus depicted in FIG. 1 is suitably employed in the practice of the present invention. This rewet solution, which is the second rewet solution employed (the first rewet solution being applied to the base coat layer), improves the top coating so that better dot gain is achieved on the coated media with pigment-based inks.

Specifically, a liquid containing a water-soluble polymer or dilute inorganic pigment dispersion, such as colloidal silica or colloidal alumina, is applied onto a porous coated medium (e.g., photobased paper) with an applicator to deliver enough volume to fill all the pores in the coating. A metering device, e.g., squeegee, towel, air knife) is used to remove excess liquid on the surface of the top coating. The wetted coating is then dried with hot air. The thickness of the coating delivered by this process is estimated to be between 0.001 and 0.5 $\mu$m, and preferably no more than about 0.1 $\mu$m thick. If the coating is too thick, then the coating is likely to greatly decrease the rate of ink vehicle penetration, resulting in poor image quality.

Examples of water-soluble polymers suitable for use in the present invention include polyvinyl alcohol and polyvinyl acetate copolymer (e.g., Airvol 523 from Air Products), polyvinyl pyrrolidone (e.g., Luviskol K30 and K90 from BASF) and other water-soluble polymers such as polyamides, cellulose derivatives, and polethylene oxide. The concentration of the water-soluble polymer is in the range of about 0.1 to 5 wt % of the second rewet solution.

Examples of colloidal silica (silica sol) suitable for this application include Nalco 1140 (particle size D=15 nm), Nalco 1034A (D=20 nm), Nalco 1060 (D=60 nm), Nalco 2326 (D=5 nm), all available from Nalco Chemical Company; Nyalcol 2034DI (D=20 nm), Nyacol 2040NH4 (D=20 nm), and Nyacol 215 (D =4 nm), all available from Akzo Nobel/Eka Chemicals; and Snowtex 40 (D =10–20 nm), Snowtex N (D=10–20 nm), Snowtex O (D=11–14 nm), Snowtex OL (D=40–50 nm), Snowtex OXS (D=4–6 nm) Snowtex YL (D=50–80 nm), and Snowtex ZL (D=70–100 nm), all available from Nissan Chemical Industries, Ltd.

Examples of pearl-like silica sol include Snowtex ST-PSM (D=18–22 nm width, 100–200 nm length), available from Nissan Chemical Industries, Ltd.

Examples of elongated silica sol include Snowtex OUP (D=10 nm width, 50–100 nm length) and Snowtex UP (D=5–20 nm width, 40–300 nm length), both available from Nissan Chemical Industries, Ltd.

An example of an alumina-coated silica sol includes Snowtex C (D=10–20 nm).2, available from Nissan Chemical Industries, Ltd.

Examples of cationic silica include Nyacol IJ222 (D=70 nm) and Nyacol IJ666 (D=5 nm), both available from Akzo Nobel/Eka Chemicals.

Figure 2:
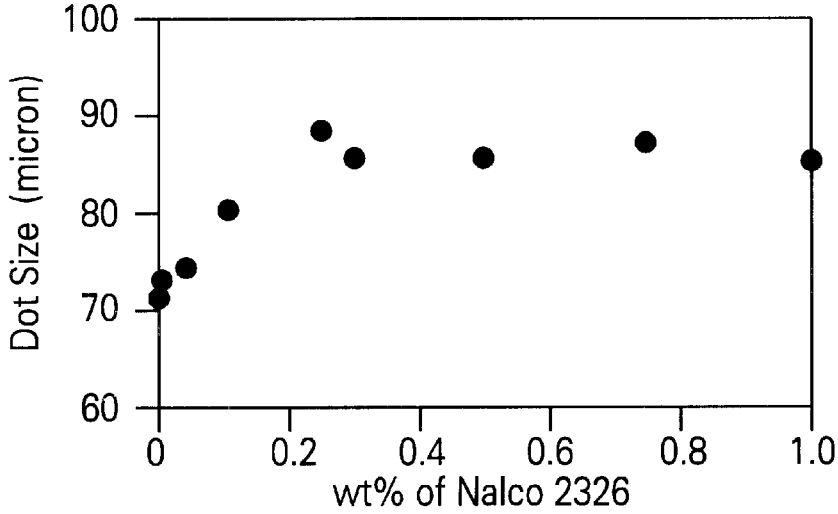
FIG. 2, on coordinates of average dot size variation (in $\mu$m) as a function of silica concentration (in wt %), shows the effect of silica concentration (Nalco 2326) on dot size.

Experiments on Nalco 2326 showed that the dot size of the printed ink increases linearly between 0 and 0.2 wt % of $SiO_2$ and it remains unchanged above 0.2 wt %; see, FIG. 2. The range of silica concentration is between 0.05 to 5 wt %, preferably between 0.1 to 1 wt %. Among all the chemicals tested, 1 wt % silica rewet solution (1 wt % silica in water; e.g., Nalco 2326) showed significantly larger dot size (85 to 90 $\mu$m) than the default dot size (65 to 70 $\mu$m) obtained without use of the rewet solution of the present invention.

Examples of colloidal alumina include Nyacol AL 20 and Nyacol AL20DW, both available from Akzo Nobel/Eka Chemicals. The range of concentration of the colloidal alumina is in the range of about 0.1 to 5 wt % of the second rewet soluction.

Surface tension reducing agents, such as water-miscible organic solvents (e.g., iso-propanol and 1-butanol, concentration in the range of 0.1 to 50 wt % of the total rewet solution), polymers (e.g., polyvinyl alcohol-polyvinyl acetate, concentration in the range of 0.01 to 0.5 wt % of the total rewet solution), or surfactants may be added to the second rewet solution to achieve better wetting and coating uniformity. Examples of surfactants that are suitably employed in the practice of the present invention include the Surfynols, which are acetylenic ethoxylated diols available from Air Products and the Dynols, which are non-ionic alkoxylated alkynols available from Air Products. The concentration of the surfactants is in the range of about 0.01 to 5 wt % of the second rewet solution.

Further, a cross-linking agent may be added to the second rewet solution to strengthen the top coat and the base coat. Examples of cross-linking agents that are suitably employed in the practice of the present invention include inorganic borates (e.g., sodium borate), glyoxal, and Tyzor, which is an organic titanate/zircronate available from E. I. Du Pont de Nemours Co. The concentration of the cross-linking agent is in the range of about 0.1 to 10 wt % of the second rewet solution.

EXAMPLES

All media were printed with a Hewlett-Packard CP-2500 printer, employing a test plot. The dot size was measured by an image analysis instrument or a microscope.

The control media was that described in related application Ser. No. 09/491,642, that is, a porous print medium coated with a base coat, a first rewet solution, and a top coat.

Example 1

A base coat and a subsequent top coat were coated onto a glossy print medium. The base coat and top coat had the composition listed in Table I below. Prior to coating the top coat, a first rewet solution, comprising heated water, was coated onto the base coat and excess was removed before applying the top coat.

TABLE I

Compositions of Base Coat and Top Coat.

| Chemical | wt % in Dry Film |
|---|---|
| Base Coat (25 g/m$^2$) | |
| precipitated amorphous $SiO_2$ | 77 |
| polyvinyl alcohol - Gohsenol NH-26 (Nippon Gohsei) | 23 |
| Top Coat (20 g/m$^2$) | |
| alumina boehmite - Dispal 9N4 (Condea Vista) | 89.4 |
| modified polyvinyl alcohol - Gohsefimer Z200 (Nippon Gohsei) | 3 |
| polyvinyl alcohol - Airvol 523 (Air Products) | 1 |
| cationic resin/polymer - Amres 8855 (Georgia-Pacific) | 4 |
| acetic acid (HOAc) | 1.6 |
| sucrose | 1 |

Following application of the top coat, then a coating of the second rewet solution was applied to the top coat, in accordance with the present invention. The compositions tested are listed in Tables II and III, below.

TABLE II

Compositions of Second Rewet Solution Containing Polymer.

| Composition | Concentration, wt % |
|---|---|
| Control | — |
| Airvol 523 (polyvinyl alcohol) | 1% |
| K90 (polyvinyl pyrrolidone) | 1% |
| K90 (polyvinyl pyrrolidone) | 3% |

TABLE III

Compositions of Second Rewet Solution Containing Colloidal Dispersion.

| Composition | Concentration, wt % |
|---|---|
| Control | — |
| Nalco 1140 ($SiO_2$) | 1% |
| Nalco 1140 ($SiO_2$) | 5% |
| Nalco 1060 ($SiO_2$) | 5% |
| Nalco 2326 ($SiO_2$) | 1% |
| Nalco 2326 ($SiO_2$) | 5% |
| Snowtex O ($SiO_2$) | 1% |
| Snowtex O ($SiO_2$) | 5% |
| Snowtex OL ($SiO_2$) | 1% |
| Snowtex OL ($SiO_2$) | 5% |
| Snowtex OXS ($SiO_2$) | 1% |
| Snowtex OXS ($SiO_2$) | 5% |

Coated media, after drying of the second rewet solution, were printed with Hewlett-Packard ultraviolet (UV) pigment-based inks on an H-P DesignJet 2500CP printer.

Figure 3A:
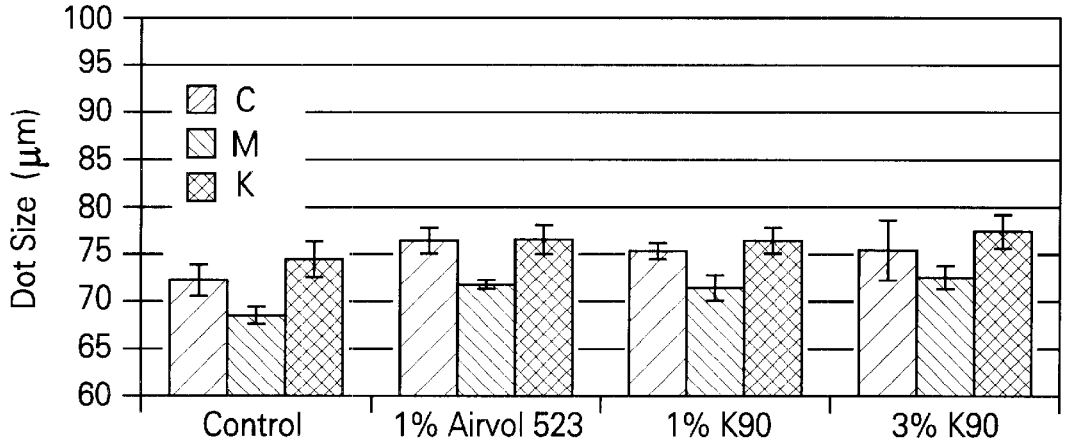
FIG. 3*a,* on coordinates of dot size (in $\mu$m) under various conditions, is a plot of dot size for cyan (C), magenta (M), and black (K) as a function of different compositions of rewet liquid containing a colloidal silica in accordance with the present invention, compared with a control.
Figure 3B:
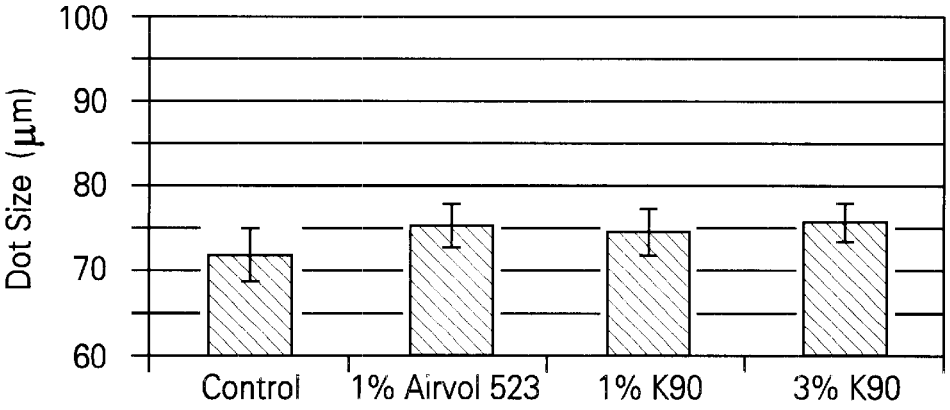
FIG. 3*b,* on coordinates of dot size (in $\mu$m) under various conditions, is a plot of average dot size as a function of different compositions as in FIG. 3*a;*
Figure 4A:
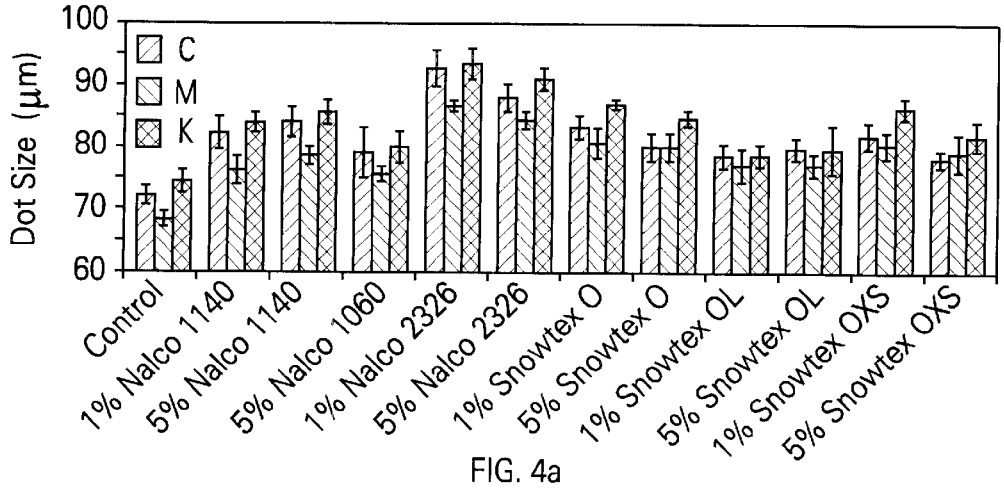
FIG. 4*a,* on coordinates of dot size (in $\mu$m) under various conditions, is a plot of dot size for cyan (C), magenta (M), and black (K) as a function of different compositions of rewet liquid containing a polymer in accordance with the present invention, compared with a control.
Figure 4B:
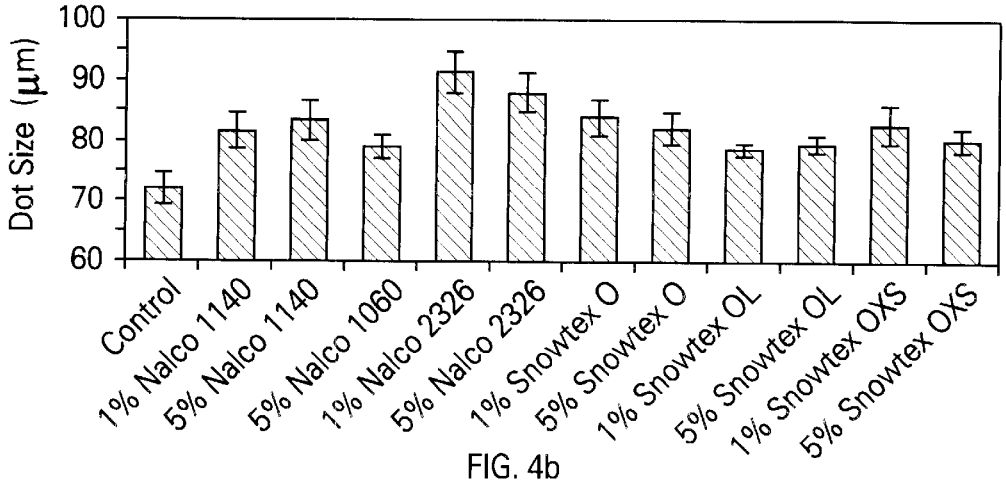
FIG. 4*b,* on coordinates of dot size (in $\mu$m) under various conditions, is a plot of average dot size as a function of different compositions as in FIG. 4*a*.

The measurements of the dot size of the printed ink are shown in FIGS. 3*a*–3*b* (for compositions listed in Table II) and in FIGS. 4*a*–4*b* (for compositions listed in Table III) for a rewet liquid containing a polymer and a colloidal dispersion, respectively. All samples showed similar image quality (IQ) (bleed, gamut and area fill uniformity) to the control.

Rewetting the media with a liquid containing a polymer increased the dot size slightly. However, rewetting the media with a liquid containing a colloidal silica showed a more significant effect on the dot size. Among all the silicas tested, Nalco 2326 (1 wt % silica) evidenced the most improvement, as shown in FIGS. 3*a*–3*b*. This increase in dot size also leads to slightly higher optical density in the print areas. In this case, the media gloss also increased from 10–12% to 25% at 20 degrees while the image gloss remained unchanged.

Table IV summarizes the dot size measurements and gloss measurements of the pigment wash coat of the present invention.

TABLE IV

Dot Size Measurements and Gloss Measurements.

| Rewet Fluid | Ave. Dot Size (μm) | Standard Deviation (μm) | Media Gloss at 20 Degrees |
|---|---|---|---|
| None | 71.0 | 2.3 | 11 |
| 5% Nalco 1060 | 78.2 | 2.5 | 4 |
| 1% Nalco 1140 | 80.9 | 2.0 | 6 |
| 5% Nalco 1140 | 82.4 | 2.1 | 15 |
| 1% Nalco 2326 | 90.8 | 2.2 | 25 |
| 5% Nalco 2326 | 87.5 | 2.1 | 28 |
| 1% Nalco IJ666 | 78.7 | 3.6 | 25 |
| 5% Nalco IJ666 | 74.6 | 2.8 | 29 |
| 5% Nalco AL20 | 76.1 | 1.8 | 36 |
| 1% Nalco AL20DW | 76.5 | 2.7 | 26 |
| 1% Snowtex 40 | 81.2 | 1.9 | 20 |
| 5% Snowtex 40 | 83.1 | 1.6 | 16 |
| 1% Snowtex C | 80.1 | 3.0 | 16 |
| 5% Snowtex C | 79.9 | 1.1 | 26 |
| 1% Snowtex N | 84.7 | 3.1 | 9 |
| 5% Snowtex N | 83.6 | 3.0 | 22 |
| 1% Snowtex O | 83.4 | 1.6 | 5 |
| 5% Snowtex O | 81.4 | 1.7 | 11 |
| 1% Snowtex OL | 78.2 | 2.2 | 6 |
| 5% Snowtex OL | 79.0 | 2.4 | 2 |
| 1% Snowtex OXS | 82.9 | 2.1 | 3 |

TABLE IV-continued

Dot Size Measurements and Gloss Measurements.

| Rewet Fluid | Ave. Dot Size (μm) | Standard Deviation (μm) | Media Gloss at 20 Degrees |
|---|---|---|---|
| 5% Snowtex OXS | 79.8 | 2.2 | 8 |
| 1% Snowtex ST-PSM | 80.6 | 2.5 | 6 |
| 5% Snowtex ST-PSM | 82.3 | 3.3 | 23 |

The average dot size represents the average dot size of different colors. All materials are seen to have larger dot diameter than the default media ("Non"). Some of the materials can also be used to enhance the media gloss (>11).

Example 2

Coating defects (e.g., fisheyes) may occur during the rewet process due to the high surface tension of the dilute pigment dispersion. Various surface tension reducing agents, such as iso-propanol (IPA), 1-butanol (BuOH), polyvinyl alcohol-polyvinyl acetate (e.g., Airvol 523), Surfynol (from Air Products), and Dynol (from Air Products) can be incorporated in the wash coat to achieve better wetting and uniformity. Examples and results are summarized in Table V.

TABLE V

Dot Size Measurements and Gloss Measurements of Different Pigment Wash Coats with Addition of Surface Tension Reducing Agent

| Rewet Fluid | Ave. Dot Size (μm) | Standard Deviation (μm) | Media Gloss at 20 Degrees |
|---|---|---|---|
| None | 71.0 | 2.3 | 11 |
| 1% Nalco 1134A + 1% IPA | 82.2 | 1.9 | 8 |
| 1% Nalco 1134A + 1% BuOH | 81.1 | 2.2 | 9 |
| 1% Nalco 1134A + 0.1% Airvol 523 | 81.5 | 2.6 | 5 |
| 1% Nalco 2326 + 1% IPA | 85.2 | 2.3 | 14 |
| 1% Nalco 2326 + 1% BuOH | 87.2 | 2.8 | 25 |
| 1% Nalco 2326 + 0.2% Dynol 604 | 86.7 | 2.0 | 8 |
| 1% Nalco 2326 + 0.2% Surfynol 504 | 91.8 | 2.2 | 18 |
| 1% Nalco 2326 + 0.1% Airvol 523 | 87.9 | 3.1 | 4 |
| 1% Nyacol 2034DI + 1% BuOH | 79.6 | 2.9 | 7 |
| 1% Nyacol 2040NH4 + 1% BuOH | 80.6 | 3.2 | 8 |
| 1% Nyacol 215 + 1% BuOH | 77.2 | 3.7 | 4 |
| 1% Nyacol IJ222 + 1% BuOH | 80.1 | 3.5 | 21 |
| 1% Snowtex C + 1% IPA | 81.1 | 1.5 | 21 |
| 1% Snowtex C + 1% BuOH | 80.4 | 1.8 | 20 |
| 1% Snowtex C + 0.1% Airvol 523 | 81.5 | 2.0 | 20 |
| 1% Snowtex OUP + 1% BuOH | 75.4 | 2.0 | 5 |
| 1% Snowtex UP + 1% BuOH | 77.2 | 2.7 | 5 |
| 1% Snowtex YL + 1% BuOH | 77.6 | 2.6 | 2 |

TABLE V-continued

Dot Size Measurements and Gloss Measurements of Different Pigment Wash Coats with Addition of Surface Tension Reducing Agent

| Rewet Fluid | Ave. Dot Size (μm) | Standard Deviation (μm) | Media Gloss at 20 Degrees |
|---|---|---|---|
| 1% Snowtex ZL + 1% BuOH | 79.2 | 3.0 | 3 |

The addition of the surface tension reducing agent provides a smoother coating of the rewet solution, without adversely affecting the dot size and the media gloss.

Example 3

A cross-linking agent that is known to cross link the top coat or the base coat can be added to the wash coat for adhesion or durability enhancement of the coating. Examples of such cross-linking agents include glyoxal and Tyzor (available from du Pont). The results are summarized in Table VI.

TABLE VI

Dot Size Measurements and Gloss Measurements of Different Pigment Wash Coats with Addition of Various Cross-Linking Agents.

| Rewet Fluid | Ave. Dot Size (μm) | Standard Deviation (μm) | Media Gloss at 20 Degrees |
|---|---|---|---|
| None | 71.0 | 2.3 | 11 |
| 1% Nalco 2326 + 0.5% glyoxal, 1% BuOH | 82.2 | 1.9 | 8 |
| 1% Nalco 2326 + 1% glyoxal, 1% BuOH | 81.1 | 2.2 | 9 |
| 1% Nalco 2326 + 1% Tyzor LA, 1% BuOH | 81.5 | 2.6 | 5 |

The addition of the cross-linking agent served to strengthen the top coat and the base coat, without adversely affecting the dot size and media gloss advantages provided by the second rewet solution of the present invention.

INDUSTRIAL APPLICABILITY

The process of the present invention is expected to find use in thermal ink-jet printing onto porous glossy print media.

What is claimed is:

1. A process for applying at least one ink-receiving layer to a non-porous substrate, said process comprising:

(a) directly forming a porous base coat on a surface of said non-porous substrate, said porous base coat comprising a plurality of pores;

(b) drying said base coat, followed by applying a first rewet liquid directly to said porous base coat to form a wetted base coat;

(c) directly forming a top coat on said wetted porous base coat; and (d) drying said top coat, followed by applying a second rewet liquid to said top coat to form a wetted top coat, wherein said second rewet liquid comprises an aqueous-based solution containing at least one species selected from the group consisting of (1) a water-soluble polymer selected from the group consisting of polyvinyl alcohol, polyvinyl acetate, polyvinyl pyrrolidone, polyamides, cellulose derivatives, and polyethylene oxide, present in a concentration of about 0.1 to 5 wt %, (2) colloidal silica, present in a concentration of about 0 to 5 wt %, and (3) colloidal alumina, present in a concentration of about 0.1 to 5 wt %, wherein ad process is performed without cast-coating or lamination and whereby said at least one ink-receiving layer is printable with larger dots of a pigment-base ink gum without said second rewet liquid.

2. The process of claim 1 wherein said base coat and said top coat each independently comprise at least one pigment, at least one binder, and at least one solvent.

3. The process of claim 2 wherein said base coat and said top coat each contain at least one pigment independently selected from the group consisting of silica, alumina, hydrates of alumina, titania, carbonates, glass beads, and organic pigments selected from the group consisting of cross-linked SBR latexes, micronized polyethylene wax, micronized polypropylene wax, acrylic beads, and methacrylic beads.

4. The process of claim 2 wherein said at least one binder of said base coat and said at least one binder of said top coat are independently selected from the group consisting of polyvinyl alcohol and its derivatives, polyvinyl pyrrolidone/polyvinyl acetate copolymer, cellulose derivatives, styrene-butadiene latexes, acrylics, and polyurethanes.

5. The process of claim 1 wherein said first rewet liquid further includes at least member selected from the group consisting of (1) at least one surfactant, (2) at least one pH modifier, (3) at least one polymer, (4) at least one crosslinker, (5) at least one pigment, and (6) at least one dye stabilizer, said at least one crosslinker operatively associated with at least one binder of either said base coat, said top coat, or both.

6. The process of claim 1 wherein said second rewet liquid further comprises at least one species selected from the group consisting of surface tension reducing agents and cross-linking agents.

7. The process of claim 6 wherein said surface tension reducing agent is selected from the group consisting of water-miscible organic solvents, polymers, and surfactants and wherein said cross-linking agent is selected from the group consisting of borates, glyoxal, and organic titanates/zirconates.

8. The process of claim 7 wherein said water-miscible organic solvent is selected from the group consisting of iso-propanol and 1-butanol, wherein said polymer comprises a copolymer of polyvinyl alcohol and polyvinyl acetate, and wherein said surfactant is selected from the group consisting of acetylenic ethoxylated diols and non-ionic alkoxylated alkynols.

9. The process of claim 7 wherein said surface tension reducing agent is added to said second rewet liquid to a concentration in the range of 0.1 to 50 wt % for said water-miscible organic solvent or 0.01 to 0.5 wt % for said polymer or 0.01 to 5 wt % for said surfactant or wherein said cross-linking agent is added to said second rewet liquid to a concentration in the range of 1 to 10 wt %.

10. A method for increasing dot size of a pigment-based ink printed on an ink-receiving layer applied to a non-permeable substrate, said method comprising:

(a) directly forming a porous base coat on a surface of said non-permeable substrate, said porous base coat comprising at least one pigment and at least one binder and further comprising a plurality of pores;

(b) drying said base coat, followed by applying a first rewet liquid directly to said porous base coat to form a liquid-coated base coat and to ensure saturation of said pores;

(c) directly forming a top coat on said liquid-coated base coat, said top coat comprising at least one pigment and at least one binder; and (d) drying said top coat, followed by applying a second rewet liquid to said top coat to form a liquid-coated top coat, wherein said second rewet liquid comprises an aqueous-base solution containing at least one species selected from the group consisting of (1) a water-soluble polymer selected from the group consisting of polyvinyl alcohol, polyvinyl acetate, polyvinyl pyrrolidone, polyamides, cellulose derivatives, and polyethylene oxide, present in a concentration of about 0.1 to 5 wt %, (2) colloidal silica, present in a concentration of about 0.1 to 5 wt %, and (3) colloidal alumina, present in a concentration of about 0.1 to 5 wt %, wherein said method is performed without cast-coating or lamination and whereby said ink-receiving layer is printable with larger dots of a pigment-base ink than without said second rewet liquid.

11. The method of claim 10 wherein said base coat and said top coat each independently comprise at least one pigment, at least one binder, and at least one solvent.

12. The method of claim 11 wherein said base coat and said top coat each contain at least one pigment independently selected from the group consisting of silica, alumina, hydrates of alumina, titania, carbonates, glass beads, and organic pigments selected from the group consisting of cross-linked SBR latexes, micronized polyethylene wax, micronized polypropylene wax, acrylic beads, and methacrylic beads.

13. The method of claim 11 wherein said at least one binder of said base coat and said at least one binder of said top coat are independently selected from the group consisting of polyvinyl alcohol and its derivatives, polyvinyl pyrrolidone/polyvinyl acetate copolymer, cellulose derivatives, styrene-butadiene latexes, acrylics, and polyurethanes.

14. The method of claim 10 wherein said first rewet liquid further includes at least member selected from the group consisting of (1) at least one surfactant, (2) at least one pH modifier, (3) at least one polymer, (4) at least one crosslinker, (5) at least one pigment, and (6) at least one dye stabilizer, said at least one crosslinker operatively associated with at least one binder of either said base coat, said top coat, or both.

15. The method of claim 10 wherein said second rewet liquid further comprises at least one species selected from the group consisting of surface tension reducing agents and cross-linking agents.

16. The process of claim 15 wherein said surface tension reducing agent is selected from the group consisting of water-miscible organic solvents, polymers, and surfactants and wherein said cross-linking agent is selected from the group consisting of borates, glyoxal, and organic titanates/zirconates.

17. The process of claim 16 wherein said water-miscible organic solvent is selected from the group consisting of iso-propanol and 1-butanol, wherein said polymer comprises a copolymer of polyvinyl alcohol and polyvinyl acetate, and wherein said surfactant is selected from the group consisting of acetylenic ethoxylated diols and non-ionic alkoxylated alkynols.

18. The process of claim 16 wherein said surface tension reducing agent is added to said second rewet liquid to a concentration in the range of 0.1 to 50 wt % for said water-miscible organic solvent or 0.01 to 0.5 wt % for said polymer or 0.01 to 5 wt % for said surfactant or wherein said cross-linking agent is added to said second rewet liquid to a concentration in the range of 1 to 10 wt %.

* * * * *